US009989333B2

(12) United States Patent
Sumi et al.

(10) Patent No.: US 9,989,333 B2
(45) Date of Patent: Jun. 5, 2018

(54) ARMOR AND VEHICLE

(71) Applicant: MITSUBISHI HEAVY INDUSTRIES, LTD., Tokyo (JP)

(72) Inventors: Daishi Sumi, Tokyo (JP); Toshio Onuma, Tokyo (JP); Hiroaki Takahashi, Tokyo (JP); Tetsuya Suzuki, Tokyo (JP); Takatomo Ushiyama, Tokyo (JP); Katsumi Takagi, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 0 days. days.

(21) Appl. No.: 15/527,486

(22) PCT Filed: Nov. 20, 2014

(86) PCT No.: PCT/JP2014/080754
§ 371 (c)(1),
(2) Date: May 17, 2017

(87) PCT Pub. No.: WO2016/079842
PCT Pub. Date: May 26, 2016

(65) Prior Publication Data
US 2017/0321995 A1 Nov. 9, 2017

(51) Int. Cl.
*F41H 7/04* (2006.01)

(52) U.S. Cl.
CPC ..... *F41H 7/042* (2013.01)

(58) Field of Classification Search
CPC ..... F41H 7/042; F41H 7/02
USPC ..... 89/36.08, 36.09, 36.02
See application file for complete search history.

(56) References Cited

U.S. PATENT DOCUMENTS 3,765,299 A * 10/1973 Pagano ..... F41H 5/0442 89/36.08
5,131,314 A * 7/1992 Hansen ..... F41H 5/013 109/79
5,200,256 A * 4/1993 Dunbar ..... B32B 15/14 428/212
5,370,034 A * 12/1994 Turner ..... F41H 5/007 109/49.5

(Continued)

FOREIGN PATENT DOCUMENTS

CN 102607332 A 7/2012
JP 2012-145313 A 8/2012

(Continued)

OTHER PUBLICATIONS

English translation of the Written Opinion of the International Searching Authority (Form PCT/ISA/237) issued in International Application No. PCT/JP2014/080754, dated Feb. 17, 2015.

(Continued)

*Primary Examiner* — Joshua E Freeman
(74) *Attorney, Agent, or Firm* — Birch, Stewart, Kolasch & Birch, LLP

(57) ABSTRACT

To parry a blast caused by an explosive object, absorb explosive energy, and improve durability. An armor to be installed on a bottom surface of a vehicle, including: a bottom plate formed to have a shape in which a central portion protrudes downward, and a porous metal member-disposed on the upper side of the bottom plate.

11 Claims, 4 Drawing Sheets

(56) References Cited

U.S. PATENT DOCUMENTS 5,866,839 A * 2/1999 Ohayon ..... F41H 5/02 89/36.02
6,298,765 B1 * 10/2001 Dvorak ..... B64G 1/56 89/36.02
7,997,182 B1 * 8/2011 Cox ..... F41H 7/042 296/187.07
8,267,003 B1 * 9/2012 Lou ..... F41H 7/042 89/36.08
8,365,649 B1 * 2/2013 Andrews ..... F41H 7/042 428/911
8,640,594 B2 * 2/2014 Treadway ..... F41H 7/042 296/187.07
2007/0084337 A1 4/2007 Strassgurtl et al.
2009/0140545 A1 * 6/2009 Greuter ..... F41H 7/042 296/187.07
2009/0322112 A1 * 12/2009 Epstein ..... F41H 7/04 296/35.1
2010/0212486 A1 * 8/2010 Kurtz ..... F41H 5/0428 89/36.02
2010/0218667 A1 9/2010 Naroditsky et al.
2010/0307329 A1 * 12/2010 Kaswen ..... F16F 9/06 89/36.08
2011/0017054 A1 * 1/2011 Naroditsky ..... F41H 7/042 89/36.02
2011/0072960 A1 * 3/2011 Hallissy ..... F41H 1/02 89/36.02
2011/0079134 A1 4/2011 Jacquemont et al.
2011/0079136 A1 * 4/2011 Bettencourt ..... F41H 5/023 89/36.08
2011/0277621 A1 * 11/2011 Joynt ..... F41H 7/042 89/36.02
2011/0314999 A1 * 12/2011 Luther ..... F41H 7/042 89/36.02
2012/0097019 A1 * 4/2012 Sherbeck ..... F41H 7/042 89/36.02
2012/0103177 A1 * 5/2012 Coltrane ..... B60F 3/0038 89/36.02
2012/0174767 A1 * 7/2012 Naroditsky ..... F41H 7/042 89/36.08
2012/0180632 A1 * 7/2012 Hunn ..... F41H 7/042 89/36.02
2012/0186428 A1 * 7/2012 Peer ..... F41H 7/042 89/36.02
2012/0192706 A1 * 8/2012 Gonzalez ..... F41H 7/042 89/36.02
2012/0192708 A1 * 8/2012 Kocher ..... F41H 7/042 89/36.08
2012/0210861 A1 * 8/2012 Tobie ..... F41H 5/007 89/36.04
2012/0325076 A1 * 12/2012 Monette, Jr. ..... B32B 37/02 89/36.02
2013/0036899 A1 2/2013 Tucker
2013/0061739 A1 3/2013 Cheong et al.
2013/0205981 A1 * 8/2013 Bayer ..... F41H 7/042 89/36.02
2013/0249244 A1 * 9/2013 Cassaday ..... B62D 25/2036 296/187.08
2014/0060303 A1 * 3/2014 Enck ..... F41H 7/042 89/36.02
2014/0150633 A1 * 6/2014 Mears ..... F41H 7/042 89/36.02
2014/0290851 A1 * 10/2014 Takagi ..... B29C 73/10 156/306.6
2014/0310938 A1 * 10/2014 Parida ..... F41H 5/04 29/428
2014/0311330 A1 * 10/2014 Parida ..... F41H 7/042 89/36.08
2014/0318359 A1 * 10/2014 Asaf ..... F41H 5/007 89/36.08
2015/0114211 A1 * 4/2015 Medwell ..... F41H 5/013 89/36.02
2017/0261291 A1 * 9/2017 Berman ..... F41H 7/044

FOREIGN PATENT DOCUMENTS

JP 5024699 B2 9/2012
JP 2013-519859 A 5/2013
WO WO 2007/020531 A1 2/2007
WO WO 2008/048703 A2 4/2008
WO WO 2011/142930 A1 11/2011

OTHER PUBLICATIONS

International Search Report (Form PCT/ISA/210) issued in International Application No. PCT/JP2014/080754, dated Feb. 17, 2015.

* cited by examiner

ARMOR AND VEHICLE

FIELD

The present invention relates to an armor for protecting a bottom of a vehicle, and a vehicle to which the armor is applied.

BACKGROUND

Conventionally, for example, Patent Literature 1 and Patent Literature 2 disclose a structure which withstands blasts or impacts caused by explosive objects such as landmines or improvised explosive devices against a bottom surface of a vehicle. Patent Literature 1 discloses an armored vehicle having a V-shaped bottom surface. Further, Patent Literature 2 discloses a configuration in which a foamed resin (polyurethane foam) is used for a portion which is a V-shaped bottom surface.

CITATION LIST

Patent Literature

Patent Literature 1: Japanese Laid-open Patent Publication No. 2012-145313

Patent Literature 2: US 2013/0,036,899 A1

SUMMARY

Technical Problem

The above-mentioned Patent Literature 1 attempts to reduce the damage from the lower side of the vehicle by releasing the blast of the explosive object to the left-right due to the V shape of the bottom surface. However, only with the V shape of the bottom surface, the effect of reducing the explosive energy (impact energy) of explosive object is low. Meanwhile, the above-mentioned Patent Literature 2 attempts to reduce the impact energy of the blast with foamed resin. However, since polyurethane foam, which is a foamed resin, has low strength at a high temperature (for example, 80° C. or higher), it is difficult to obtain an effect of reducing the impact energy of the blast. For this reason, for example, there is a limitation on vehicle operation in a desert zone, which is a high-temperature environment. Further, many resins are easily burnt, and there is a problem of generation of toxic gas when burnt. Thus, the resin is not suitable for members receiving an explosive load. Further, Patent Literature 2 discloses a configuration in which a flame retardant is added to a foamed resin or a protective coating such as silicon coating is applied to the bottom surface of a foamed resin. However, since the foamed resin is, of course, a material having relatively low heat resistance, it is not possible to expect to have a great effect on high temperature. Further, many resins have problems of deterioration against oxygen, moisture, heat, ultraviolet rays, and the like, and are not suitable as exterior members.

The present invention solves the above-mentioned problem, and an object thereof is to provide an armor and a vehicle capable of parrying a blast caused by an explosive object, absorbing explosive energy, and improving durability.

Solution to Problem

To achieve the above-mentioned object, an armor according to the present invention disposed on a bottom surface of a vehicle includes a bottom plate formed to have a shape in which a central portion protrudes downward, and a porous metal member disposed on the upper side of the bottom plate.

According to this armor, the blast of the explosive object is parried to the outside of the vehicle by the bottom plate, and the explosive energy of the explosive object is absorbed and buffered by the porous metal member. Since the porous metal member is made of metal, the buffering function can be maintained even at a high temperature exceeding 80° C. The porous metal member is hard to burn and able to maintain the buffering function, and is able to maintain the buffering function without being deteriorated by oxygen, moisture, heat, ultraviolet rays, or the like. As a result, according to the armor, it is possible to parry the blast caused by the explosive object, absorb the explosive energy, and improve the durability.

Furthermore, in the armor according to the present invention, the porous metal member is made of a foamed metal material.

According to the armor, the foamed metal material is suitable as a buffering material, can effectively obtain the function of absorbing explosive energy, has appropriate strength, and can also obtain durability under normal conditions.

Furthermore, in the armor according to the present invention, the porous metal member is made of a hollow metal aggregate formed by joining a plurality of hollow metal materials.

According to the armor, the hollow metal aggregate is suitable as a buffering material, can effectively obtain the function of absorbing explosive energy, has appropriate strength, and can also obtain durability under normal conditions.

Furthermore, in the armor according to the present invention, the porous metal member is formed in a plate shape, and a plurality of porous metal members is disposed by being laminated on the upper side of the bottom plate.

According to the armor, by laminating and disposing the plate-like porous metal members, the manufacturing operation can be easily performed. Further, by laminating and disposing the plate-like porous metal members, it is possible to dispose different types of porous metal members, and it is possible to obtain desired protection performance in accordance with the specifications of the vehicle.

Furthermore, in the armor according to the present invention, a support portion which integrally supports the bottom plate and the porous metal member is provided on the upper side of the porous metal member, and the support portion is fixed to the vehicle.

According to the armor, the bottom plate and the porous metal member are integrated by the support portion and fixed to the vehicle. Accordingly, it is possible to easily attach and detach the armor to and from the vehicle.

Furthermore, in the armor according to the present invention, a rib is formed on the upper surface of the bottom plate.

According to the armor, the bottom plate can be reinforced by the rib, and it is possible to improve the durability to withstand blasts and explosive energy of explosive object.

Furthermore, in the armor according to the present invention, a connecting piece connected to the vehicle is provided on an outer peripheral edge of the bottom plate.

According to the armor, by connecting the outer peripheral edge of the bottom plate to the vehicle through the connecting piece, it is possible to improve the mounting strength to the vehicle, and to improve the durability against vibration and wind during traveling of the vehicle.

Furthermore, the armor according to the present invention, further includes the bottom plate formed to have a shape in which a central portion protrudes downward, and the porous metal member disposed on the upper side of the bottom plate. At least the bottom plate being further disposed on the upper side of the porous metal member.

According to the armor, it is possible to reinforce the armor by further disposing at least the bottom plate on the upper side of the porous metal member, and it is possible to improve the durability to withstand the blast and the explosive energy of the explosive object. In addition, as long as the porous metal member is further disposed on the upper side of the disposed bottom plate, it is possible to improve the buffering function for absorbing the explosive energy. Further, when the porous metal member is further disposed, the upper and lower porous metal members can be made as different types, and it is possible to obtain the desired protection performance in accordance with the specification of the vehicle.

Furthermore, in the armor according to the present invention, the armor is configured to be attachable to and detachable from the vehicle.

According to the armor, the armor can be attached to the existing vehicle. Also, the armor can be mounted only as needed. For example, when transporting the vehicle, by separately transporting the vehicle while detaching the armor, it is possible to reduce the weight of the vehicle, reduce the transportation costs, and transport a plurality of vehicles together.

To achieve the above-mentioned object, any one of the above-described armors is disposed as a bottom surface of a vehicle main body.

According to the vehicle, the blast of explosive object is parried to the outside of the vehicle main body by the bottom plate, and the explosive energy of the explosive object is absorbed and buffered by the porous metal member. Since the porous metal member is made of metal, the buffering function can be maintained even at a high temperature exceeding 80° C. The porous metal member is hard to burn and able to maintain the buffering function, and is able to maintain the buffering function without being deteriorated by oxygen, moisture, heat, ultraviolet rays, or the like. As a result, according to the vehicle, by disposing the armor, it is possible to parry the blast caused by the explosive object and to absorb the explosive energy, thereby improving the survivability of the vehicle and the occupant.

Furthermore, in the vehicle according to the present invention, the vehicle is an armored vehicle.

The armored vehicle travels on a road surface of a zone assumed to be subjected to blast and impact caused by explosive objects such as landmines and improvised explosive devices. Accordingly, when the aforementioned armor is disposed on the bottom surface of the vehicle, it is possible to parry the blast caused by the explosive object and to absorb the explosive energy, thereby remarkably obtaining the effect of improving the survivability of the vehicle and the occupant.

Advantageous Effects of Invention

According to the present invention, it is possible to parry a blast caused by explosive objects, absorb explosive energy, and improve durability.

DESCRIPTION OF EMBODIMENTS

Hereinafter, embodiments of the present invention will be described in detail with reference to the drawings. The present invention is not limited by the embodiments. In addition, constituent elements in the following embodiments include those that can be easily replaced by those skilled in the art or substantially the same.

Figure 1:
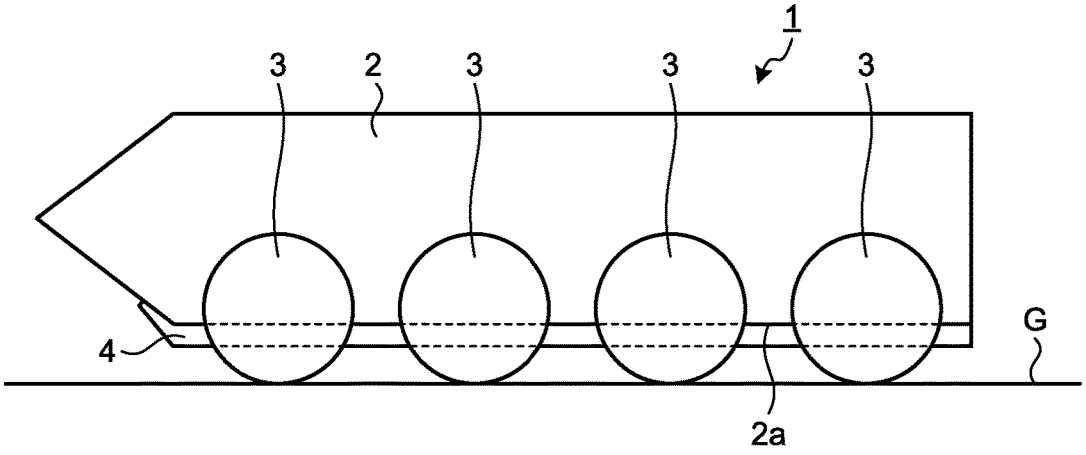
FIG. 1 is a side view of a vehicle according to an embodiment of the present invention.
Figure 2:
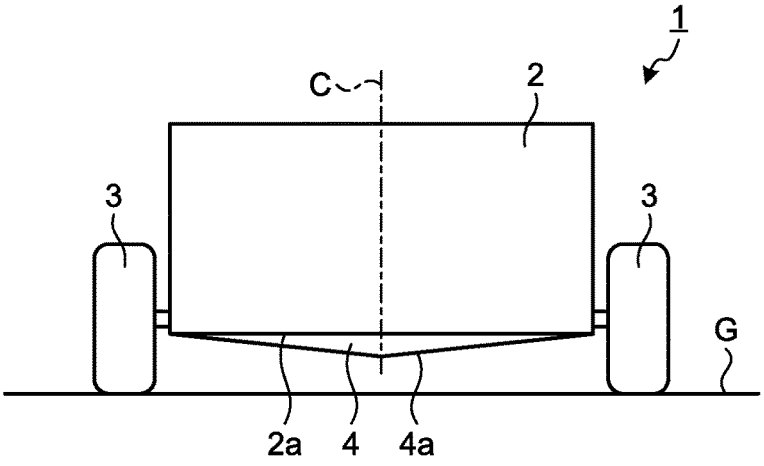
FIG. 2 is a rear view of the vehicle according to the embodiment of the present invention.
Figure 3:
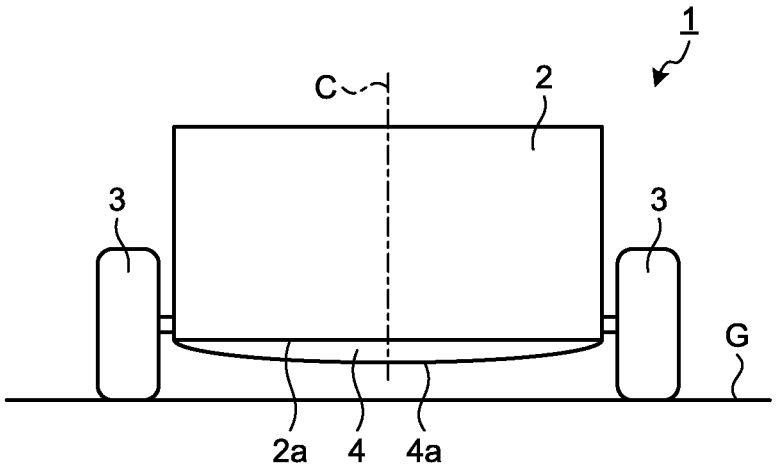
FIG. 3 is a rear view of the vehicle according to the embodiment of the present invention.
Figure 4:
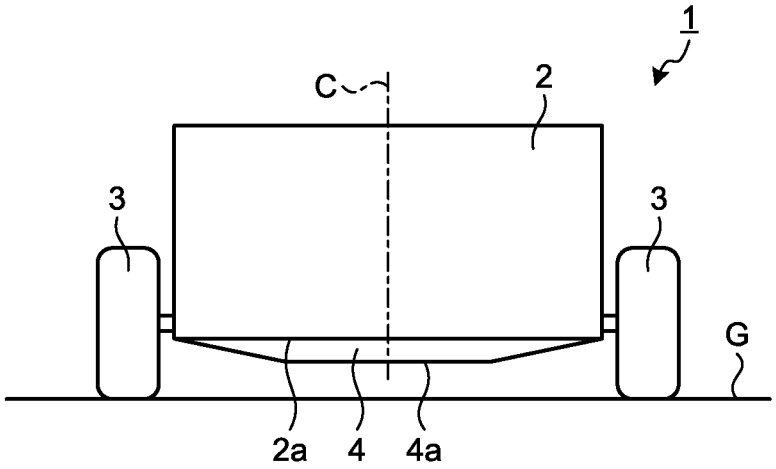
FIG. 4 is a rear view of the vehicle according to the embodiment of the present invention.
Figure 5:
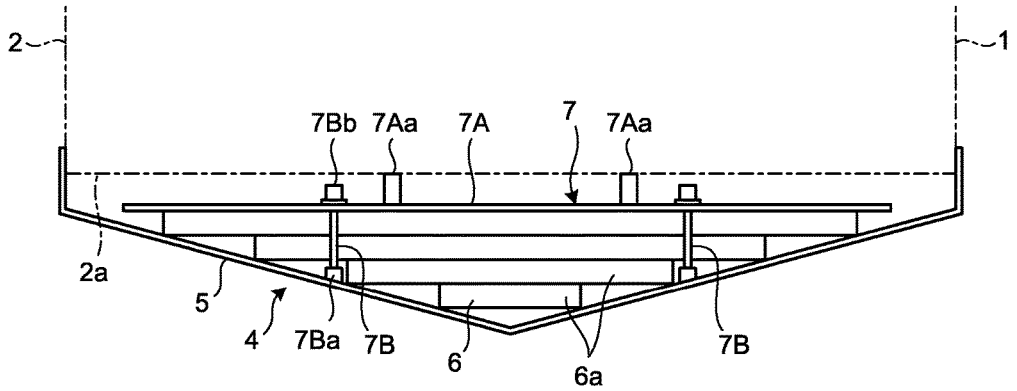
FIG. 5 is a cross-sectional view of an armor according to the embodiment of the present invention.
Figure 6:
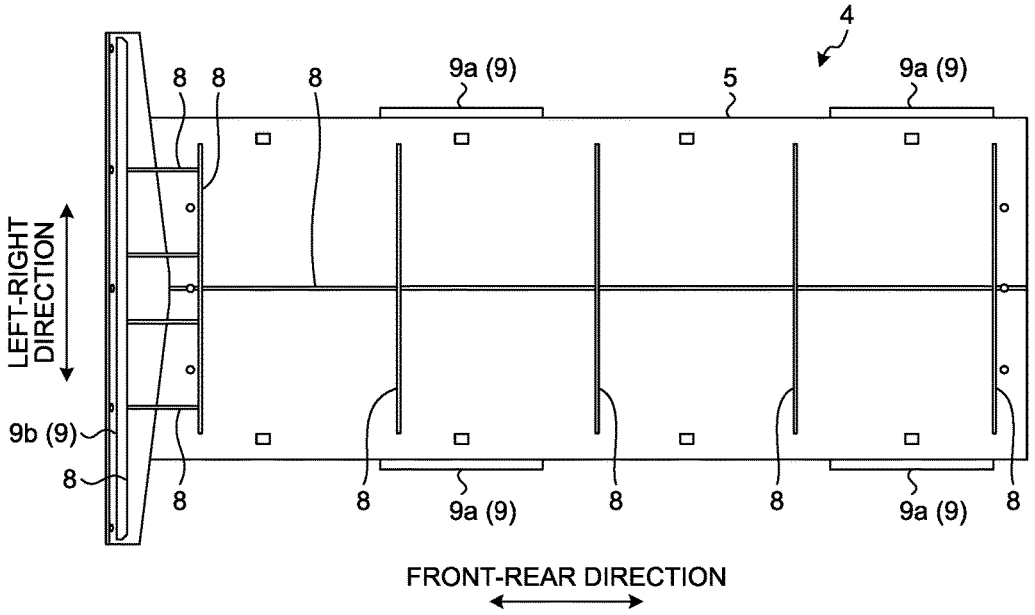
FIG. 6 is a plan view of a bottom plate of the armor according to the embodiment of the present invention.
Figure 7:
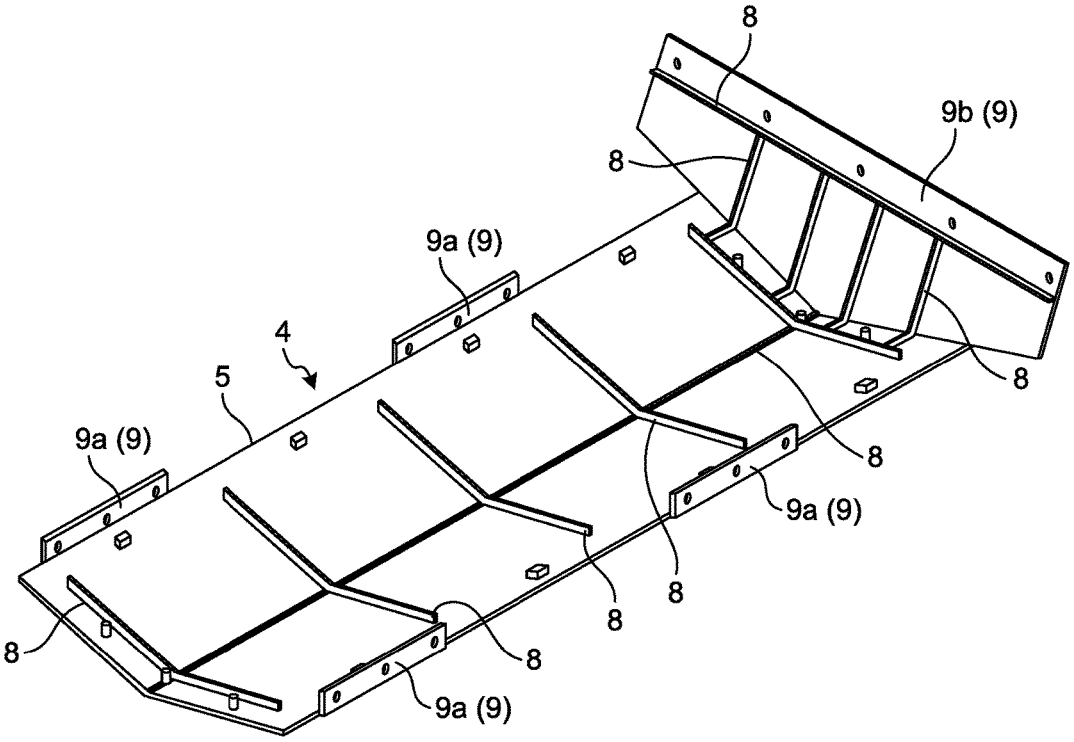
FIG. 7 is a perspective view of a bottom plate in the armor according to the embodiment of the present invention.
Figure 8:
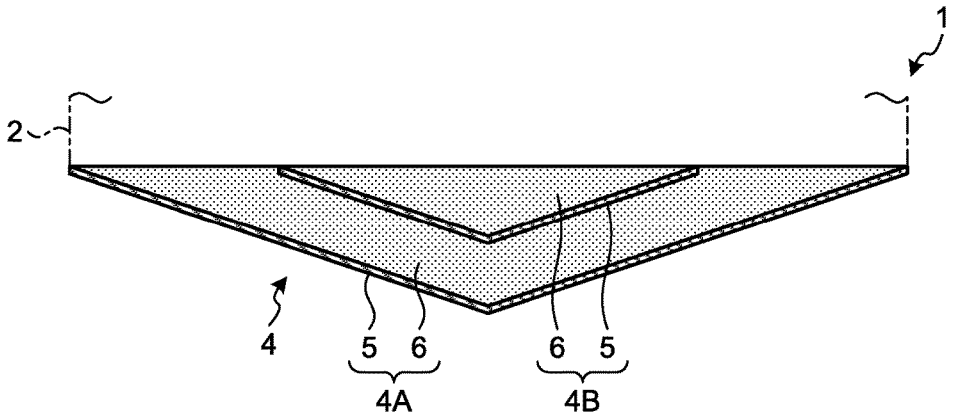
FIG. 8 is a cross-sectional view illustrating another example of the armor according to the embodiment of the present invention.

FIG. 1 is a side view of a vehicle according to an embodiment of the present invention. FIGS. 2 to 4 are rear views of the vehicle according to the embodiment of the present invention. FIG. 5 is a cross-sectional view of an armor according to the embodiment of the present invention. FIG. 6 is a plan view of a bottom plate of the armor according to the embodiment of the present invention. FIG. 7 is a perspective view of a bottom plate in the armor according to the embodiment of the present invention. FIG. 8 is a cross-sectional view illustrating another example of the armor according to the embodiment of the present invention.

A vehicle 1 of the present embodiment is mainly an armored vehicle and FIGS. 1 to 4 illustrate a wheeled armored vehicle. Although not specified in the drawings, the armored vehicle may be a tracked armored vehicle. As illustrated in FIGS. 1 to 4, the vehicle 1 mainly includes a vehicle main body 2 and wheels 3. Although not specified in the drawings, the vehicle main body 2 is designed to allow an occupant to steer the traveling, and is provided with a drive unit such as an engine or a motor, a power transmission mechanism which transmits the power of the drive unit to the driving wheels of the wheels 3, a steering mechanism which operates the steering wheels of the wheels 3, and the like. The wheel 3 is supported by the vehicle main body 2 via an axle, and has the driving wheels to which the driving force of the driving unit is transmitted, and the steering wheels which change the traveling direction of the vehicle main body 2. The driving wheels and the steering wheels may be the same wheels 3.

An armor 4 of the present embodiment is provided on a bottom surface of such a vehicle 1, that is, a bottom surface 2*a* of the vehicle main body 2. The armor 4 is provided to protrude downward from the bottom surface 2*a* of the vehicle main body 2. Specifically, as illustrated in FIG. 2, the bottom surface 4*a* of the armor 4 protrudes to the lowest side at the central portion of the vehicle main body 2 in a left-right direction, gradually inclines upward in the left-right direction from that portion, and is formed in a V shape. Further, as illustrated in FIG. 3, the bottom surface 4*a* of the armor 4 protrudes to the lowest side at the central portion of the vehicle main body 2 in the left-right direction, gradually curves upward in the left-right direction from that portion, and is formed in a U shape. Further, as illustrated in FIG. 4, the bottom surface 4*a* of the armor 4 protrudes to the lowest side at the central portion of the vehicle main body 2 in the left-right direction, is formed flat at the portion, gradually inclines (or curves) upward in the left-right direction from the flattened left-right ends, and is formed into a trapezoidal shape. Further, in particular, the central portion of the vehicle main body 2 in the left-right direction is a portion including a center C in the left-right direction, and the armor 4 preferably protrudes to the lowest side on the center C. In addition, the inclination of the bottom surface 4*a* of the armor 4 with respect to a horizontal plane is preferably large in the case of inclination, and the curvature of the bottom surface 4*a* of the armor 4 is preferably small in the case of the curve. Further, as illustrated in FIG. 1, the armor 4 is provided on the entire bottom surface 2*a* of the vehicle main body 2. When the armor 4 is provided on at least a part of the bottom surface 2*a* of the vehicle main body 2, it is preferable to dispose the armor 4 on the lower side of the portion on which the occupant rides.

As illustrated in FIG. 5, the armor 4 includes a bottom plate 5 and a porous metal member 6. The bottom plate 5 forms the shape of the bottom surface 4*a* of the armor 4, and has the function of parrying the blast of the explosive object. Due to the shape of the aforementioned bottom surface 4*a*, the bottom plate 5 has a higher strength against the curve as compared to the flat state. The bottom plate 5 is made of metal or fiber reinforced plastic. The bottom plate 5 is preferably formed of a single plate to secure its strength, but the bottom plate 5 may be formed by joining two or more plate materials by welding, bonding, or the like. Further, a plurality of bottom plate 5 may be formed by overlapping. FIG. 5 illustrates a configuration in which, as an example of the shape of the bottom plate 5, the bottom plate 5 is formed in a V shape in accordance with the shape of the bottom surface 4*a* of the armor 4 illustrated in FIG. 2.

The porous metal member 6 is disposed above the bottom plate 5 and between the bottom plate 5 and the bottom surface 2*a* of the vehicle main body 2, and functions as a buffering element which absorbs the explosive energy of the explosive object. The porous metal member 6 is a so-called porous metal, and is made up of, for example, a hollow metal aggregate formed by joining a plurality of foamed metal materials or a plurality of hollow metal materials. The foamed metal material is made of, for example, a metal mainly containing an aluminum alloy, and has a large amount of small air bubbles generated by gas. The air bubbles may be independent of each other as a single foam, or may be connected to each other as an open foam. Further, the hollow metal aggregate is obtained by sintering a preformed hollow metal ball or solidifying the metal ball with an adhesive or the like. The porous metal member 6 may be formed as one block and disposed between the bottom plate 5 and the bottom surface 2*a* of the vehicle main body 2. In this embodiment, however, as illustrated in FIG. 5, a plate-like member 6*a* formed to have a predetermined width or length may be disposed by being laminated on the top of the bottom plate 5. Further, when the porous metal member 6 is laminated as the plate-like member 6*a*, different types (for example, the above-described foamed metal material or hollow metal aggregate) may be laminated.

Further, the armor 4 has a support portion 7. The support portion 7 integrally supports the bottom plate 5 and the porous metal member 6, and fixes the bottom plate 5 and the porous metal member 6 to the bottom surface 2*a* of the vehicle main body 2. The support portion 7 has a support plate 7A that is attached to the upper side of the porous metal member 6. Further, the support portion 7 has a connecting member 7B that connects the support plate 7A and the bottom plate 5. The connecting member 7B has a female screw portion 7Ba fixed to the upper surface of the bottom plate 5, and a bolt 7Bb which is screwed with the female screw portion 7Ba through the support plate 7A and the porous metal member 6 and has a head portion abutting against the upper surface of the support plate 7A. That is, the connecting member 7B connects the support plate 7A and the bottom plate 5 with the porous metal member 6 interposed therebetween, thereby integrating the bottom plate 5 and the porous metal member 6. Further, a plurality of bosses 7Aa is formed to protrude upward from the upper surface of the support plate 7A. The support plate 7A is fixed to the bottom surface 2*a* of the vehicle main body 2 via the bosses 7Aa. For example, although not specified in the drawing, a female screw is formed in the boss 7Aa, and a bolt penetrating from the inside of the vehicle main body 2 is screwed into the female screw, thereby fixing the armor 4 to the bottom surface 2*a* of the vehicle main body 2 via the support plate 7A. Further, for example, although not specified in the drawing, a hole is formed in the boss 7Aa, and a rivet penetrating from the inside of the vehicle main body 2 is fitted to the hole, thereby fixing the armor 4 to the bottom surface 2*a* the vehicle main body 2 via the support plate 7A. In this way, by fixing the armor 4 to the vehicle 1 with bolts or rivets, the armor 4 can be attached to and detached from the vehicle 1. Alternatively, for example, although not specified in the drawing, the armor 4 is fixed to the bottom surface 2*a* of the vehicle main body 2 via the support plate 7A, by welding and joining the boss 7Aa to the bottom surface 2*a* of the vehicle main body 2.

Further, as illustrated in FIGS. 6 and 7, the armor 4 has ribs 8 formed on the upper surface of the bottom plate 5. When the ribs 8 are fixed to the vehicle 1 on the bottom plate 5, the ribs 8 extending in the front-rear direction of the vehicle 1, and the ribs 8 extending in the left-right direction of the vehicle 1 are formed to intersect with each other. The ribs 8 reinforce the bottom plate 5. Most of the porous metal members 6 have the Poisson's ratio close to 0, and even if the porous metal members 6 are surrounded by the rib 8, there is no influence on the function as a buffer.

Further, as illustrated in FIGS. 6 and 7, the armor 4 is provided with a connecting piece 9 connected to the outer peripheral edge of the vehicle main body 2 of the vehicle 1, on the outer peripheral edge of the bottom plate 5. The connecting piece 9 is connected to the outer peripheral edge of the vehicle main body 2 by bolts, rivets or welding. In FIGS. 6 and 7, the connecting piece 9 illustrates connecting pieces 9*a* connected to the left and right outer peripheral edges of the vehicle main body 2, and a connecting piece 9*b* connected to the outer peripheral edge on the front side of the vehicle main body 2. As illustrated in FIG. 1, the connecting piece 9*b* is disposed along an inclination in which the outer peripheral edge on the front side of the vehicle main body 2 is inclined upward from below. It is also preferable that ribs 8 also be provided on the connecting pieces 9*a* and 9*b* for reinforcement.

Further, as illustrated in FIG. 8, the armor 4 of this embodiment has a plurality of (two in FIG. 8) armor units 4A and 4B which includes a bottom plate 5 formed in a downward protruding shape, and the porous metal member 6 disposed on the top of the bottom plate 5. Each of the armor units 4A and 4B may be configured to be laminated one above the other. The bottom plate 5 of the lower armor unit 4A forms the shape of the bottom surface 2*a* (see FIG. 1) of the vehicle main body 2. The upper armor unit 4B is disposed on the upper side of the porous metal member 6 of the lower armor unit 4A, and the bottom plate 5 is formed along the shape of the bottom plate 5 of the lower armor unit 4A. The porous metal member 6 is disposed on the upper side of the bottom plate 5 of the upper armor unit 4B. In each of the armor units 4A and 4B, the upper and lower porous metal members 6 may be of different types (for example, the aforementioned foamed metal material or hollow metal aggregate). Further, the upper armor unit 4B may not have the porous metal member 6. Specifically, the armor 4 includes the bottom plate 5 formed in a downward protruding shape, and the porous metal member 6 disposed on the upper side of the bottom plate 5, and at least the bottom plate 5 is further disposed on the upper side of the porous metal member 6.

As described above, the armor 4 of the present embodiment is disposed as the bottom surface 2*a* of the vehicle main body 2 of the vehicle 1, and includes the bottom plate 5 formed to have a shape in which a central portion protrudes downward, and the porous metal member 6 disposed on the upper side of the bottom plate 5.

According to the armor 4, the blast of the explosive object is parried to the outside of the vehicle main body 2 by the bottom plate 5, and the explosive energy of the explosive object is absorbed and buffered by the porous metal member 6. Since the porous metal member 6 is made of metal, the buffering function can be maintained even at a high temperature exceeding 80° C. The porous metal member 6 is hard to burn and able to maintain the buffering function, and is able to maintain the buffering function without being deteriorated by oxygen, moisture, heat, ultraviolet rays, or the like. As a result, according to the armor 4, it is possible to parry the blast caused by the explosive object, absorb the explosive energy, and improve the durability.

The porous metal member 6 is a so-called porous metal and has various crushing strengths ranging from less than 1 MPa to several tens of MPa, and any material having an arbitrary strength may be applied in accordance with the vehicle 1 to be protected. If the porous metal member 6 having a large crushing strength is adopted for the vehicle 1 having a relatively thick bottom surface 2*a* of the vehicle main body 2, it is possible to minimize the volume and the weight of the protective plate. The porous metal member 6 having a low crushing strength is adopted for the vehicle 1 having the relatively small thickness of the bottom surface 2*a* of the vehicle main body 2. If the porous metal member 6 has a large thickness, a desired protection performance can be obtained.

Further, in the armor 4 of the present embodiment, the porous metal member 6 is preferably made of a foamed metal material.

According to the armor 4, the foamed metal material is suitable as a buffering material, can effectively obtain the function of absorbing explosive energy, has appropriate strength, and can also obtain durability under normal conditions.

In the armor 4 of the present embodiment, it is preferable that the porous metal member 6 be made of a hollow metal aggregate formed by joining a plurality of hollow metal materials.

According to the armor 4, the hollow metal aggregate is suitable as a buffering material, can effectively obtain the function of absorbing explosive energy, has appropriate strength, and can also obtain durability under normal conditions.

Further, in the armor 4 of the present embodiment, it is preferable that the porous metal member 6 be formed in a plate shape and a plurality of the porous metal members 6 be disposed by being laminated on the upper side of the bottom plate 5.

According to the armor 4, by laminating and disposing the plate-like porous metal members 6, the manufacturing operation can be easily performed. Further, by laminating and disposing the plate-like porous metal members 6, it is possible to dispose different types of porous metal members 6, and it is possible to obtain desired protection performance in accordance with the specifications of the vehicle 1.

In the armor 4 of the present embodiment, the support portion 7 which integrally supports the bottom plate 5 and the porous metal member 6 is preferably provided on the upper side of the porous metal member 6, and the support portion 7 is preferably fixed to the vehicle main body 2 of the vehicle 1.

According to the armor 4, the bottom plate 5 and the porous metal member 6 are integrated by the support portion 7 and fixed to the vehicle 1. Accordingly, it is possible to easily perform the installation operation of the armor 4 to the vehicle 1. Moreover, the bottom plate 5 and the porous metal member 6 are integrated by the support portion 7 and fixed to the vehicle 1. Accordingly, the armor 4 can be easily attached to and detached from the vehicle 1.

Further, in the armor 4 of the present embodiment, it is preferable that the rib 8 be formed on the upper surface of the bottom plate 5.

According to the armor 4, the bottom plate 5 can be reinforced by the rib 8, and it is possible to improve the durability to withstand blasts and explosive energy of explosive objects.

Further, in the armor 4 of the present embodiment, it is preferable that the connecting piece 9 connected to the vehicle main body 2 of the vehicle 1 be provided on the outer peripheral edge of the bottom plate 5.

According to the armor 4, by connecting the outer peripheral edge of the bottom plate 5 to the vehicle 1 by the connecting piece 9, it is possible to improve the mounting strength to the vehicle 1, and to improve the durability against vibration and wind during traveling of the vehicle 1.

Further, the armor 4 of the present embodiment preferably includes the bottom plate 5 formed to have a shape in which a central portion protrudes downward, and the porous metal member 6 disposed on the upper side of the bottom plate 5, and at least the bottom plate 5 is preferably further included on the upper side of the porous metal member 6.

According to the armor 4, it is possible to reinforce the armor 4 by further disposing at least the bottom plate 5 on the upper side of the porous metal member 6, and it is possible to improve the durability to withstand the blast and the explosive energy of the explosive object. In addition, by further disposing the porous metal member 6 on the upper side of the disposed bottom plate 5, it is possible to improve the buffering function for absorbing the explosive energy. Further, when the porous metal member 6 is further disposed, the upper and lower porous metal members 6 can be made as different types, and it is possible to obtain the desired protection performance in accordance with the specification of the vehicle 1.

Further, in the armor 4 of the present embodiment, it is preferable that the armor 4 be configured to be attachable to and detachable from the vehicle main body 2 of the vehicle 1.

According to the armor 4, the armor 4 can be attached to the existing vehicle 1. Also, the armor 4 can be mounted only as needed. For example, when transporting the vehicle 1, by separately transporting the vehicle 1 while detaching the armor 4, it is possible to reduce the weight of the vehicle 1, reduce transportation costs, and transport a plurality of vehicles 1 together.

In the vehicle 1 of the present embodiment, the aforementioned armor 4 is disposed as the bottom surface 2*a* of the vehicle main body 2.

According to the vehicle 1, the blast of explosive object is parried to the outside of the vehicle main body 2 by the bottom plate 5, and the explosive energy of the explosive object is absorbed and buffered by the porous metal member 6. Since the porous metal member 6 is made of metal, the buffering function can be maintained even at a high temperature exceeding 80° C. The porous metal member 6 is hard to burn and able to maintain the buffering function, and is able to maintain the buffering function without being deteriorated by oxygen, moisture, heat, ultraviolet rays, or the like. As a result, according to the vehicle 1, by disposing the armor 4, it is possible to parry the blast caused by the explosive object and to absorb the explosive energy, thereby improving the survivability of the vehicle and the occupant.

Further, the vehicle 1 of the present embodiment is an armored vehicle.

The armored vehicle travels on a road surface G (see FIG. 1) of a zone assumed to be subjected to blast and impact caused by explosive objects such as landmines and improvised explosive devices. Accordingly, when the aforementioned armor 4 is disposed on the bottom surface 2*a* of the vehicle main body 2, it is possible to parry the blast caused by the explosive object and to absorb the explosive energy, thereby remarkably obtaining the effect of improving the survivability of the vehicle and the occupant.

REFERENCE SIGNS LIST

1 VEHICLE
2 VEHICLE MAIN BODY
2*a* BOTTOM SURFACE
4 ARMOR
4*a* BOTTOM SURFACE
5 BOTTOM PLATE
6 POROUS METAL MEMBER
6*a* PLATE-LIKE MEMBER
7 SUPPORT PORTION
8 RIB
9 CONNECTING PIECE

The invention claimed is:

1. An armor disposed on a bottom surface of a vehicle, the armor comprising:
- a bottom plate formed to have a shape in which a central portion protrudes downward;
- a porous metal member disposed on the upper side of the bottom plate; and
  - a support portion provided on an upper side of the porous metal member and integrally supporting the bottom plate and the porous metal member,
  - wherein the support portion has a support plate attached to the upper side of the porous metal member, a connecting member connecting the support plate and the bottom plate with the porous metal member interposed therebetween, and a plurality of bosses formed to protrude upward from the upper surface of the support plate and fixed to the vehicle.

2. The armor according to claim 1, wherein the porous metal member is made of a foamed metal material.

3. The armor according to claim 1, wherein the porous metal member is made of a hollow metal aggregate formed by joining a plurality of hollow metal materials.

4. The armor according to claim 1, wherein the porous metal member is formed in a plate shape, and a plurality of porous metal members is disposed by being laminated on the upper side of the bottom plate.

5. The armor according to claim 1, wherein a rib is formed on the upper surface of the bottom plate.

6. The armor according to claim 1, wherein a connecting piece connected to the vehicle is provided on an outer peripheral edge of the bottom plate.

7. The armor according to claim 6, wherein a front part of the connecting piece is disposed along an inclination in which the outer peripheral edge on the front side of the vehicle main body is inclined upward from below.

8. The armor according to claim 1, wherein the armor is configured to be attachable to and detachable from the vehicle.

9. A vehicle in which the armor according to claim 1 is disposed as a bottom surface of a vehicle main body.

10. The vehicle according to claim 9, wherein the vehicle is an armored vehicle.

11. The armor according to claim 1 further comprising:
- at least one of upper bottom plates that are different from the bottom plate, wherein the at least one of upper bottom plates is disposed on the upper side of the porous metal member.

* * * * *